US008505692B2

(12) United States Patent
Tokura et al.

(10) Patent No.: US 8,505,692 B2
(45) Date of Patent: Aug. 13, 2013

(54) ELEVATOR SYSTEM

(75) Inventors: Sakurako Tokura, Tokyo (JP); Yoshimasa Koba, Tokyo (JP); Koji Takeshima, Aichi (JP); Masayuki Mitsuda, Aichi (JP); Yoshinori Nonami, Aichi (JP); Masafumi Iwata, Tokyo (JP); Naohiko Suzuki, Tokyo (JP); Shingo Kobori, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 318 days.

(21) Appl. No.: 13/057,197

(22) PCT Filed: Sep. 18, 2008

(86) PCT No.: PCT/JP2008/066867

§ 371 (c)(1), (2), (4) Date: Feb. 2, 2011

(87) PCT Pub. No.: WO2010/032307

PCT Pub. Date: Mar. 25, 2010

(65) Prior Publication Data

US 2011/0132699 A1 Jun. 9, 2011

(51) Int. Cl.
*B66B 1/18* (2006.01)

(52) U.S. Cl.
USPC ..... 187/382; 187/391

(58) Field of Classification Search
USPC ..... 187/247, 248, 380–389, 391–396
See application file for complete search history.

(56) References Cited

U.S. PATENT DOCUMENTS

| | | | | |
|---|---|---|---|---|
| 4,852,696 | A * | 8/1989 | Fukuda et al. | 187/392 |
| 5,192,836 | A | 3/1993 | Schroder | |
| 5,271,484 | A * | 12/1993 | Bahjat et al. | 187/387 |
| 5,338,904 | A * | 8/1994 | Powell et al. | 187/387 |
| 6,360,849 | B1 * | 3/2002 | Hikita | 187/381 |
| 7,484,597 | B2 * | 2/2009 | Nikovski et al. | 187/382 |
| 7,490,698 | B2 * | 2/2009 | Sirag, Jr. | 187/381 |

(Continued)

FOREIGN PATENT DOCUMENTS

| | | | |
|---|---|---|---|
| CN | 101209790 | A | 7/2008 |
| JP | 58-22276 | A | 2/1983 |

(Continued)

OTHER PUBLICATIONS

International Search Report issued Apr. 21, 2009 in PCT/JP08/066867 filed Sep. 18, 2008.

(Continued)

*Primary Examiner* — Anthony Salata
(74) *Attorney, Agent, or Firm* — Oblon, Spivak, McClelland, Maier & Neustadt, L.L.P.

(57) ABSTRACT

Provided is an elevator system which can perform an optimum assignment suited to the operation condition of elevators and can appropriately notify a user of accurate information. For this purpose, there are provided a call registration device which registers a destination call before boarding and a notification device which provides elevator information. Normally, immediately after registration of a destination call, the notification device provides information on an assigned car. On the other hand, when a prescribed assignment review condition is met, immediately after registration of a destination call, the notification device provides information to the effect that the registration has been accepted, thereafter the assignment of the elevator is reviewed, and the notification device provides information on an assigned car when the elevator responds to the destination call.

6 Claims, 3 Drawing Sheets

(56) References Cited

U.S. PATENT DOCUMENTS

| | | | | |
|---|---|---|---|---|
| 7,975,808 | B2 * | 7/2011 | Smith et al. | 187/382 |
| 7,987,947 | B2 * | 8/2011 | Christy et al. | 187/249 |
| 8,177,036 | B2 * | 5/2012 | Stanley et al. | 187/396 |
| 2011/0048866 | A1 | 3/2011 | Tokura | |

FOREIGN PATENT DOCUMENTS

| | | | |
|---|---|---|---|
| JP | 58-176857 | A | 11/1983 |
| JP | 2 261786 | | 10/1990 |
| JP | 4-226285 | A | 8/1992 |
| JP | 4 226286 | | 8/1992 |
| JP | 6 255913 | | 9/1994 |
| JP | 2000 272850 | | 10/2000 |
| JP | 2001 287876 | | 10/2001 |
| JP | 2001 348170 | | 12/2001 |
| JP | 2006 117398 | | 5/2006 |

OTHER PUBLICATIONS

U.S. Appl. No. 13/510,326, filed May 17, 2012, Mitsuda, et al.
U.S. Appl. No. 12/595,523, filed Oct. 12, 2009, Tokura.
Japanese Office Action issued on Feb. 19, 2013 in patent Application No. 2010-529539 with English translation.
Office Action issued Jul. 19, 2012, in Korean Patent Application No. 10-2011-7003912 with Partial English translation.
U.S. Appl. No. 13/260,111, filed Sep. 23, 2011, Tokura.
Office Action mailed Mar. 7, 2013 in Chinese Patent Application No. 200880131163.6 (with English Translation).

* cited by examiner

ELEVATOR SYSTEM

TECHNICAL FIELD

The present invention relates to an elevator system which performs group supervisory control of a plurality of elevators and enables a user to register his or her destination floor (destination call) before boarding an elevator.

BACKGROUND ART

In buildings and the like where there are many elevator users, a plurality of elevators are installed within the same building and these plurality of elevators are group-supervisory-controlled in order to improve the operation efficiency of all elevators.

A conventional art of such an elevator system is described in Patent Document 1 below. In the elevator system described in Patent Document 1, a call registration device is installed in an elevator hall so that a user can resister his or her destination floor (destination call) before boarding an elevator. When an elevator has been assigned to the destination call registered from this call registration device, the information on the assigned car is indicated on an indication device installed in juxtaposition with the call registration device in order to notify the user.

Patent Document: Japanese Patent Laid-Open No. 2001-287876

DISCLOSURE OF THE INVENTION

Problems to be Solved by the Invention

In the elevator system described in Patent Document 1, the information on the assigned car is immediately indicated to the user who has registered his or her destination call from the call registration device and, therefore, this has posed the problem that in some operation conditions of elevators and the like, it is impossible to perform an optimum assignment.

That is, a call registration device from which users register their destination calls is not always installed in the vicinity of an elevator entrance. For this reason, when a call registration device is installed in a place at a distance from an elevator entrance, this has posed the problem that it takes time for a user to arrive at the elevator entrance after making sure of the information on the assigned car in an indication section of the call registration device and that the operation condition of elevators changes during the movement of the user.

Even when a call registration device is installed in the vicinity of an elevator entrance, it may sometimes take time before a response is made to a registered destination call. In such a case, the operation condition of elevators changes until the response is made and hence it has sometimes been impossible to perform an optimum assignment.

The present invention was made to solve the problems described above, and the object of the present invention is to provide an elevator system which can perform an optimum assignment suited to the operation condition of elevators and can appropriately notify users of accurate information.

Means for Solving the Problems

An elevator system according to the present invention is an elevator system which performs group supervisory control of a plurality of elevators. This elevator system comprises a call registration device with which a user registers his or her destination call before boarding an elevator, a notification device which notifies the user of elevator information, and a group controller which, upon registration of a destination call from the call registration device, assigns an optimum elevator to the destination call from the plurality of elevators and causes the notification device to provide information on an assigned car. Normally, the group controller causes the notification device to provide information on an assigned car immediately after registration of a destination call. In the case where a prescribed assignment review condition is met, the group controller causes, immediately after registration of a destination call, the notification device to provide information to the effect that the registration has been accepted, thereafter reviews the assignment of the elevator, and causes the notification device to provide information on an assigned car when the elevator responds to the destination call.

Effect of the Invention

According to the present invention, in an elevator system which performs group supervisory control of a plurality of elevators, it is possible to perform an optimum assignment suited to the operation condition of elevators and it becomes possible to appropriately notify users of accurate information.

BRIEF OF DESCRIPTION OF THE DRAWINGS

DESCRIPTION OF SYMBOLS

1 call registration device,
2 assignment result notification device,
3 display,
4 numerical keys,
5 group controller,
6 assigned car notification device,
7 assignment control function section,
8 assigned car judgment means,
9 assignment change judgment means,
10 display,
11 each-elevator controller,
12 car control means,
13 data on kinds of call,
14 building specification data,
15 assignment change probability computing means

BEST MODE FOR CARRYING OUT THE INVENTION

The present invention will be described in more detail with reference to the accompanying drawings. Incidentally, in each of the drawings, like numerals refer to like or similar parts and redundant descriptions of these parts are appropriately simplified or omitted.

FIRST EMBODIMENT

Figure 1:
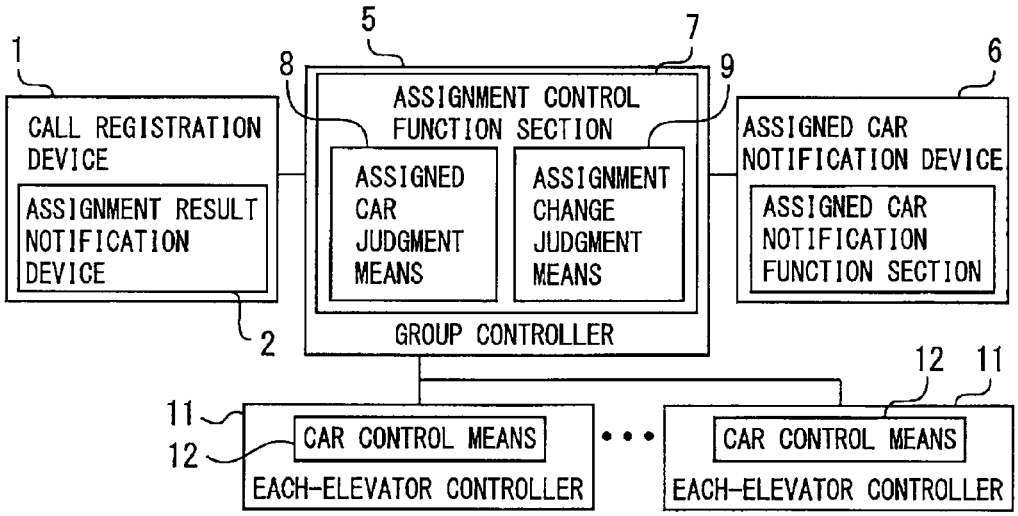
FIG. 1 is a block diagram showing an elevator system in a first embodiment according to the present invention.

FIG. 1 is a block diagram showing an elevator system in a first embodiment according to the present invention. The elevator system shown in FIG. 1 has the function of group supervisory controlling a plurality of elevators installed within the same building and the like.

In FIG. 1, reference numeral 1 denotes a call registration device with which a user registers his or her destination floor (destination call) before boarding an elevator, and reference numeral 2 denotes an assignment result notification device (a first notification device) which notifies users of elevator information. That is, an elevator user can register his or her destination call by operating the call registration device 1 in a prescribed manner before boarding. At this time, the assignment result notification device 2 notifies the user of information on the registration of the destination call.

Figure 2:
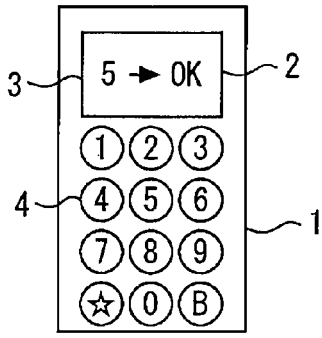
FIG. 2 is a diagram showing an example of a call registration device in the first embodiment according to the present invention.

FIG. 2 is a diagram showing an example of a call registration device in the first embodiment according to the present invention, and shows how the call registration device 1 and the assignment result notification device 2 are integrally configured. When such a call registration device 1 is installed, an elevator user inputs his or her destination floor (destination call) by operating numerical keys 4 while making sure of the indication contents of a display 3. When the destination call has been registered, prescribed information, such as assignment result, is indicated on the display 3.

The configuration of the call registration device 1 and the assignment result notification device 2 is not limited to that shown in FIG. 2, and any configuration is allowed so long as the call registration device 1 and the assignment result notification device 2 have the above-described functions.

For example, the above-described call registration device 1 may be provided with a destination call button for each floor at which an elevator stops. Also, the call registration device 1 may be a portable terminal which is capable of being carried by an elevator user and permits radio communication with a group controller 5, which will be described later. For example, a cell phone, a PHS (Personal Handyphone System), a PDA (Personal Digital Assistance) and a notebook PC can be used as the above-described portable terminal.

Furthermore, the call registration device 1 may be a device which has a personal ID check function and personal ID data as the function of registering destination calls and which, when a user inputs his or her personal ID, automatically checks and registers the destination call of the user by referring to the above-described personal ID data. In such a case, the checking of a personal ID of the user is performed on the basis of, for example, a system by a key, a card, an IC tag or the like in which a personal ID is recorded, or a system by biometric information, such as a fingerprint, a vein pattern, a voiceprint and an iris pattern.

The call registration device 1 (when the call registration device 1 is a portable terminal, the receiver thereof) is installed, for example, in an elevator hall, in the vicinity of the hall or on a passage leading to the hall.

On the other hand, the assignment result notification device 2 may be a device which informs users of information by performing audio guidance from a speaker in addition to notifying users of information by indicating characters, symbols, pictures and the like by use of the above-described display 3 and the like. Also, the assignment result notification device 2 may be a device which provides information by illuminated indications by use of a lamp and the like. Incidentally, it is not always necessary that the assignment result notification device 2 be constructed integrally with the call registration device 1, and the assignment result notification device 2 may be installed separately from the call registration device 1. However, the assignment result notification device 2 is installed in the vicinity of the call registration device 1 because it has the function of notifying a user who registers his or her destination call and a user who has registered his or her destination call of information.

A group controller 5 has the function of group controlling a plurality of elevators installed within the same building and the like. Concretely, upon registration of a destination call from the call registration device 1, the group controller 5 assigns an optimum elevator to the registered destination call from the above-described plurality of elevators and causes the assignment result notification device 2 and an assigned car notification device 6 (a second notification device), which will be described later, to provide information on the assigned car.

In order to realize the above-described function, the group controller 5 has an assignment control function section 7. Concretely, the assignment control function section 7 has a control function related to assignment, and the essential part thereof is composed of assigned car judgment means 8 and assignment change judgment means 9.

When an assignment to a destination call is necessary, the assigned car judgment means 8 has the function of assigning an elevator which is optimal at that point of time to the above-described destination call on the basis of the operation condition of elevators. Concretely, when a destination call has been registered from the call registration device 1, the assigned car judgment means 8 performs an assignment to the destination call. Also when it is necessary to review a destination call to which an assignment has been carried out, on the basis of the operation condition of elevators, the assigned car judgment means 8 carries out a re-assignment to the destination call whose review is necessary.

The assignment change judgment means 9 has the function of making a judgment as to whether or not a review of an assignment is necessary for the destination call for which the assignment of an elevator has been performed once. Concretely, a prescribed condition for reviewing an assignment (hereinafter referred to as "an assignment review condition") is stored beforehand in the assignment change judgment means 9, and a judgment is made as to whether or not it is necessary to review an assignment depending on whether or not this assignment review condition is met. That is, after registration of a destination call from the call registration device 1, the assignment change judgment means 9 makes a judgment as to whether or not the above-described assignment review condition is met for a duration until an elevator responds to the destination call, and when it is judged that the assignment review condition is met, the assignment change judgment means 9 outputs assignment instructions to the assigned car judgment means 8.

Also, as described above, the group controller 5 also has the function of causing the assignment result notification device 2 and the assigned car notification device 6 to provide information on assigned cars. Concretely, normally when the assignment review condition is not met, the group controller 5 sends prescribed instructions to the assignment result notification device 2 immediately after registration of a destination call from the call registration device 1 and causes the assignment result notification device 2 to provide information on the assigned car. That is, when the above-described assignment review condition is not met, an elevator user can get to know his or her own assigned car from the information provided immediately after registration of his or her destination call.

On the other hand, when the assignment review condition is met, the group controller 5 performs a temporary assignment by the assigned car judgment means 8 immediately after registration of a destination call, and sends prescribed instructions to the assignment result notification device 2, thereby causing the assignment result notification device 2 to provide only information to the effect that the destination call has been accepted. The group controller 5 thereafter makes a judgment as to whether or not it is necessary to review the assignment to the above-described destination call and carries out a re-assignment to the above-described destination call if the review is necessary. When the elevator responds to the destination call, the group controller 5 sends prescribed instructions to the assigned car notification device 6 and causes the assigned car notification device 6 to provide information on the assigned car.

Figure 3:
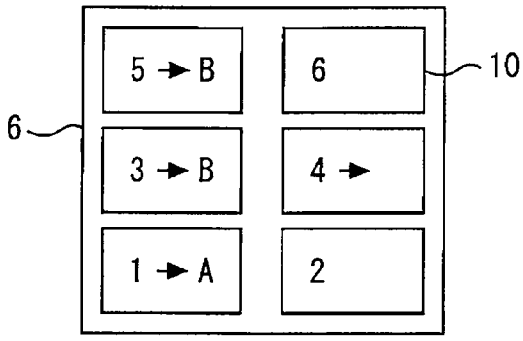
FIG. 3 is a diagram showing an example of an assigned car notification device of the first embodiment according to the present invention.

The above-described assigned car notification device 6 is installed in an elevator hall in order to notify users who are present in the elevator hall of the information on assigned cars. FIG. 3 is a diagram showing an example of the assigned car notification device of the first embodiment according to the present invention, and shows an assigned car notification device 6 which provides information by indicating the information on assigned cars on a display 10.

The assigned car notification device 6 is not limited to the configuration shown in FIG. 3, and any configuration is permitted so long as the assigned car notification device 6 has the above-described function.

For example, the assigned car notification device 6 may notify users of information by performing audio guidance from a speaker or may provide information by illuminated indications by use of a lamp and the like. Also, the assigned car notification device 6 may be configured integrally with the assignment result notification device 2. Furthermore, the assigned car notification device 6 may be composed of a portable terminal permitting radio communication with the group controller 5 and may be configured to serve also as the call registration device 1.

The operation control of each elevator is performed by an each-elevator controller 11. That is, on the basis of an output signal from the group controller 5, the each-elevator controller 11 appropriately controls the whole operation of each elevator including the car by use of car control means 12 and the like.

Components of the elevator system shown in FIG. 1, i.e., the call registration device 1, the assignment result notification device 2, the group controller 5, the assigned car notification device 6, and the each-elevator controller 11 are connected by a network and are configured to perform mutual information communication.

Figure 4:
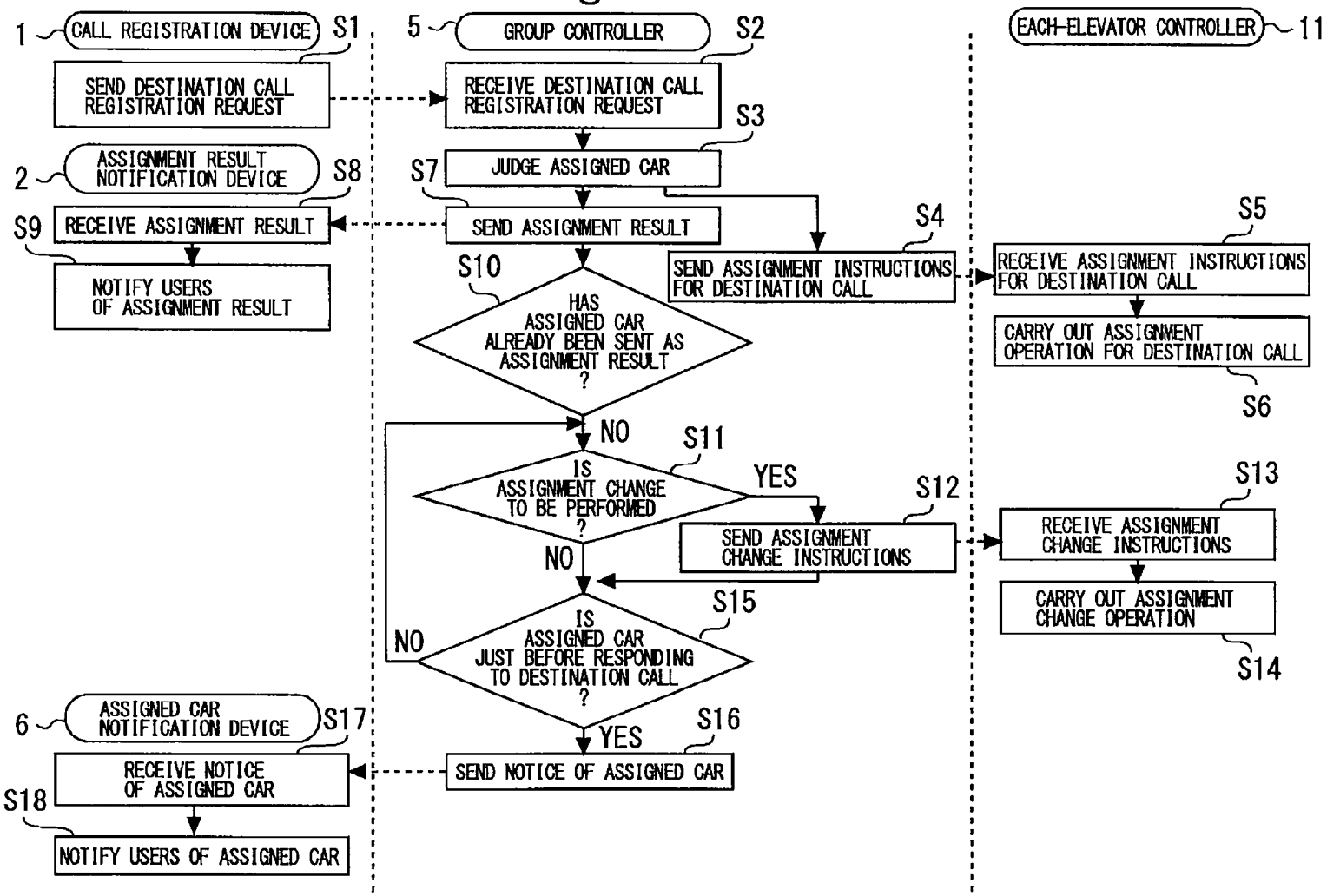
FIG. 4 is a flowchart showing the operations of the elevator system in the first embodiment according to the present invention.

Next, on the basis of FIG. 4, a description will be given of concrete operations of the elevator system having the above-described configuration. FIG. 4 is a flowchart showing the operations of the elevator system in the first embodiment according to the present invention.

The flowchart of FIG. 4 shows the case where the number of elevators capable of responding to a destination call is set as the above-described assignment review condition. That is, upon registration of a destination call from the call registration device 1, the group controller 5 calculates the number of elevators capable of responding to the destination call and makes a judgment as to whether or not the assignment review condition is met on the basis of the calculation results.

Concrete operations will be described below.

When an elevator user registers a destination call, in which his or her destination floor is specified, from the call registration device 1, a destination call registration request is sent from the call registration device 1 to the group controller 5 (S1). Upon receipt of the destination call registration request from the call registration device 1 (S2), the group controller 5 judges an assigned car to meet the destination call registration request by use of the assignment control function section 7 (S3) and judges elevators capable of responding to the destination call registration request on the basis of prescribed conditions, such as the response time, running direction and operating status.

On the basis of the judgment result of an assigned car in S3, the group controller 5 sends assignment instructions to meet the destination call to the each-elevator controller 11 (S4). By receiving the call assignment instructions from the group controller 5, the each-elevator controller 11 performs a call assignment operation (S5, S6).

On the basis of the judgment result of an assigned car in S3 and the judgment result of the elevators capable of responding, the group controller 5 sends the assignment result to meet the above-described destination call registration request (S7). By receiving the assignment result from the group controller 5, the assignment result notification device 2 notifies users of necessary information by performing indication, announcement and the like (S8, S9). For example, when there is only one elevator capable of responding to the destination call, the group controller 5 regards the car assigned to the destination call as the assignment result and in S9, causes the assignment result notification device 2 to notify the information on the assigned car. On the other hand, when there are a plurality of elevators capable of responding to the destination call, the group controller 5 regards the information to the effect that the destination call registration has been accepted as the assignment result and in S9, causes the assignment result notification device 2 to provide the information to that effect.

After sending the assignment instructions to the each-elevator controller 11 and the assignment result to the assignment result notification device 2, the group controller 5 carries out a review of the assignment by the assignment change judgment means 9.

Concretely, first, the group controller 5 makes a judgment as to whether or not the assigned car has already been sent as the assignment result in S7 (S10). When only the information to the effect that a destination call registration has been accepted is provided by the assignment result notification device 2 (that is, when there are a plurality of elevators capable of responding to the destination call and the above-described assignment review condition is met), the group controller 5 makes a judgment as to whether or not an assignment change (a review of the assignment) is to be performed by the assignment change judgment means 9, and when it is judged that an assignment change is necessary, the group controller 5 sends assignment change instructions to the each-elevator controller 11 (S11, S12). The each-elevator controller 11 which has received the assignment change instructions performs an assignment change operation on the basis of the instructions (S13, S14).

In S11 above, on the basis of, for example, the operation condition of elevators, the assignment change judgment means 9 makes a judgment as to whether or not an assignment change is necessary. Concretely, the assignment change judgment means 9 judges that an assignment change is necessary when the operation condition of elevators has changed. Then, by sending assignment instructions to the assigned car judgment means 8, the assignment change judgment means 9 causes the assigned car judgment means 8 to perform a re-assignment to the destination call. A change in the operation condition of elevators refers to the case where a new hall call or a new car call has occurred, the case where the position (floor) of a car has changed, and the like. Because the operation condition of elevators changes constantly, the assignment change judgment means 9 may also be configured to send assignment instructions to the assigned car judgment means 8 each time a given time elapses in S11 above.

When in S11 the group controller 5 judges that an assignment change is unnecessary or after the group controller 5 sends assignment change instructions in S12, the group controller 5 makes a judgment as to whether or not the assigned car is just before responding to the destination call (S15) and repeats the operations of S11 and S12 above until just before the response. Then, just before the assigned car responds to the destination call, the group controller 5 sends a notice of the assigned car at that point of time to the assigned car notification device 6 (S16). The assigned car notification device 6 which has received the notice of the assigned car notifies users who are present in halls of the information on the assigned car by performing indication, announcement and the like (S17, S18).

FIG. 4 shows the case where a notice of the assigned car is sent just before the assigned car responds to the destination call. This "just before a response" refers to, for example, the timing when the assigned car has started an arrival operation in the destination call direction at the floor for which the destination call had been registered, the timing when the assigned car has started a door opening operation in the destination call direction on the floor for which the destination call had been registered, and the like. The "just before a response" may also refer to the timing a given time before the arrival at the floor for which the destination call had been registered in the destination call direction.

On the other hand, when in S9 the information on the assigned car is provided by the assignment result notification device 2 (that is, there is only one elevator capable of responding to the destination call and the above-described assignment review condition is not met), the group controller 5 sends a notice of the assigned car to the assigned car notification device 6.

According to the first embodiment of the present invention, in the elevator system which performs group supervisory control of a plurality of elevators, it is possible to perform an optimum assignment according to the operation condition of the elevators and it becomes possible to appropriately notify users of accurate information.

That is, in the case where an elevator user has registered his or her destination call and a plurality of elevators can respond to the destination call, a review of the assignment is performed even thereafter according to the operation condition of elevators. For this reason, it is possible to perform an optimum assignment suited to the operation condition of elevators and it becomes possible to provide more comfortable services to the user. In such a case, when the user registers his or her destination call, the information on the assigned car is not provided by the assignment result notification device 2 and only the information to the effect that the destination call has been registered is provided. That is, by delaying the timing of providing the information on the assigned car, it becomes possible to perform an optimum assignment suited to the operation condition of elevators and furthermore it becomes possible to appropriately notify the user of accurate information.

SECOND EMBODIMENT

Figure 5:
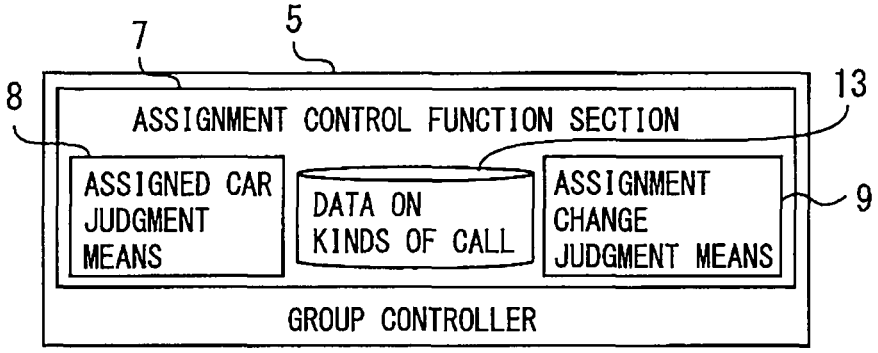
FIG. 5 is a block diagram showing the essential part of an elevator system in a second embodiment according to the present invention.

FIG. 5 is a block diagram showing the essential part of an elevator system in a second embodiment according to the present invention. In FIG. 5, an assignment control function section 7 of a group controller 5 has data on kinds of call 13 in addition to assigned car judgment means 8 and assignment change judgment means 9. The elevator system is configured in such a manner that a plurality of kinds of destination call can be registered from a call registration device 1 installed in an elevator hall and the like. That is, the call registration device 1 sends a destination call registration request, including the data on the kind of destination call, to the group controller 5.

In the elevator system having the above-described configuration, on the basis of the kind of destination call registered from the call registration device 1, the group controller 5 (assignment change judgment means 9) makes a judgment as to whether the assignment review condition is met. That is, upon receipt of the destination call registration request from the call registration device 1, the group controller 5 judges an assigned car to meet the destination call registration request by use of the assignment control function section 7 and identifies the kind of destination call registered from the call registration device 1 by referring to the data on the kinds of call 13. When as a result, it is judged that the assignment review condition is not met, for example, in the case where only one elevator can respond to the destination call registered from the call registration device 1 in order to perform a VIP operation or an operation for a wheelchair user, or in the case where unnecessariness for an assignment change is set for the destination call due to the taste of the user and the like. In such cases, the group controller 5 regards the car assigned to the destination call as the assignment result and causes the assignment result notification device 2 to provide the information on the assigned car.

On the other hand, when it is judged on the basis of the kind of destination call registered from the call registration device 1 that a plurality of elevators can respond to the destination call, the group controller 5 regards the information to the effect that the destination call has been accepted as the assignment result, and causes the assignment result notification device 2 to provide the information to that effect.

Other components and operations are the same as in the first embodiment.

According to the second embodiment of the present invention, in the elevator system which performs group supervisory control of a plurality of elevators, it is possible to perform an optimum assignment on the basis of the kind of destination call registered from the call registration device 1. Also, it becomes possible to appropriately notify users of accurate information.

THIRD EMBODIMENT

Figure 6:
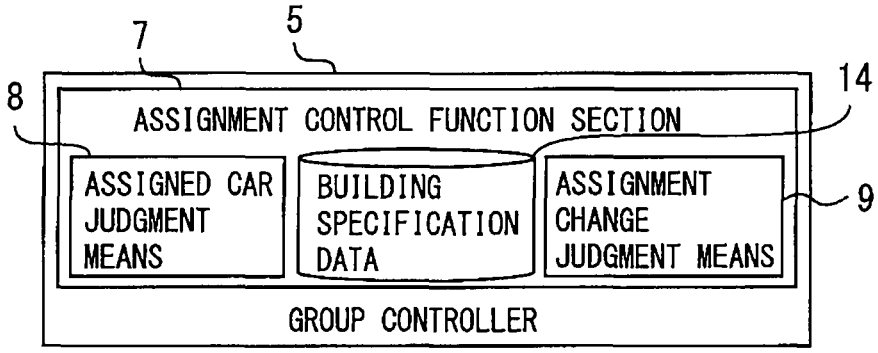
FIG. 6 is a block diagram showing the essential part of an elevator system in a third embodiment according to the present invention.

FIG. 6 is a block diagram showing the essential part of an elevator system in a third embodiment according to the present invention. In FIG. 6, a group controller 5 has building specification data 14 in addition to assigned car judgment means 8 and assignment change judgment means 9. Data on the positional relationship between a call registration device 1 and an elevator entrance (an elevator hall) is contained in this building specification data 14.

In the elevator system having the above-described configuration, on the basis of the distance between the call registration device 1 and an elevator entrance, the group controller 5 (the assignment change judgment means 9) makes a judgment as to whether or not an assignment review condition is met. That is, upon receipt of a destination call registration request from the call registration device 1, the group controller 5 judges an assigned car to meet the destination call registration request by use of an assignment control function section 7 and determines the distance between the call registration device 1 and an elevator entrance by referring to the building specification data 14. As a result, when the distance between the call registration device 1 and an elevator entrance is shorter than a prescribed value, the group controller 5 judges that the assignment review condition is not met. In such a case, the group controller 5 regards the car assigned to the destination call as the assignment result and causes an assignment result notification device 2 to provide the information on the assigned car.

On the other hand, when the distance between the call registration device 1 and an elevator entrance is not less than a prescribed value, the group controller 5 regards the information to the effect that the destination call has been accepted as the assignment result, and causes the assignment result notification device 2 to provide the information to that effect.

Other components and operations are the same as in the first embodiment.

According to the third embodiment of the present invention, in the elevator system which performs group supervisory control of a plurality of elevators, it is possible to perform an optimum assignment on the basis of the distance between the call registration device 1 and an elevator entrance. That is, even when the call registration device 1 is installed in a place at a distance from an elevator entrance and it takes a time for an elevator user to arrive at the elevator entrance after registering his or her destination call, it is possible to carry out an appropriate assignment suited to the operation condition of the elevators. Even when an assignment review is performed, it is possible to notify users of accurate information.

FOURTH EMBODIMENT

Figure 7:
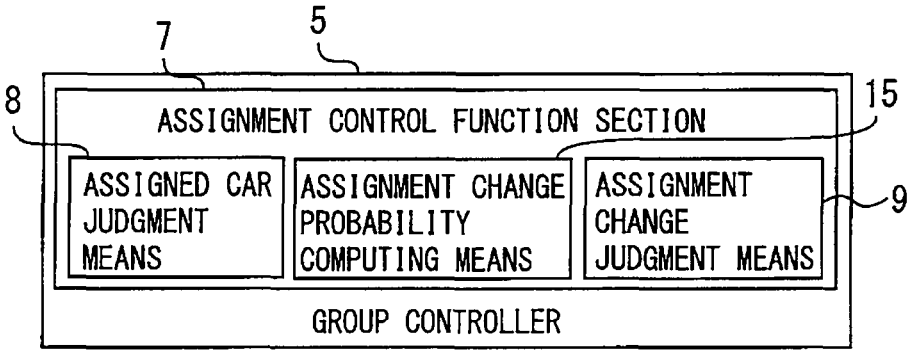
FIG. 7 is a block diagram showing the essential part of an elevator system in a fourth embodiment according to the present invention.

FIG. 7 is a block diagram showing the essential part of an elevator system in a fourth embodiment according to the present invention. In FIG. 7, a group controller 5 has assignment change probability computing means 15 in addition to assigned car judgment means 8 and assignment change judgment means 9.

In the elevator system having the above-described configuration, on the basis of the probability of an assignment change of a destination call, the group controller 5 makes a judgment as to whether or not the assignment review condition is met. That is, upon registration of a destination call from the call registration device 1 and receipt of a destination call registration request, the group controller 5 judges the assigned car to meet the destination call registration request by use of a assignment control function section 7 and computes the probability of an assignment change of the above-described destination call being made. The assignment change judgment means 9 judges that the assignment review condition is not met if the computation result (i.e., the computed probability) of the assignment change probability computing means 15 is less than a prescribed value. In such a case, the group controller 5 regards the car assigned to the destination call as the assignment result, and causes the assignment result notification device 2 to provide the information on the assigned car.

On the other hand, when the probability of an assignment change computed by the assignment change probability computing means 15 is not less than a prescribed value, the group controller 5 regards the information to the effect that the destination call has been accepted as the assignment result, and causes the assignment result notification device 2 to provide the information to that effect.

Other components and operations are the same as in the first embodiment.

According to the fourth embodiment of the present invention, in the elevator system which performs group supervisory control of a plurality of elevators, it is possible to perform an optimum assignment on the basis of the probability of an assignment change being made. Also, it becomes possible to appropriately notify users of accurate information. That is, even when there are a plurality of elevators capable of responding to a destination call registered from the call registration device 1, it becomes possible to determine an assigned car when a destination call is registered if the probability of an assignment change which may be made thereafter is low, and to notify users of the result.

Industrial Applicability

The elevator system of the present invention can be applied to an elevator system in which a plurality of elevators are group-supervisory-controlled and elevator users can register their destination calls before boarding.

The invention claimed is:

1. An elevator system which performs group supervisory control of a plurality of elevators, comprising:

a call registration device with which a user registers his or her destination call before boarding an elevator;

a notification device which notifies the user of elevator information; and a group controller which, upon registration of a destination call from the call registration device, assigns an optimum elevator to the destination call from the plurality of elevators and causes the notification device to provide information on an assigned car, wherein normally the group controller causes the notification device to provide information on an assigned car immediately after registration of a destination call; and in the case where a prescribed assignment review condition is met, the group controller causes, immediately after registration of a destination call, the notification device to provide information to the effect that the registration has been accepted, thereafter reviews the assignment of the elevator, and causes the notification device to provide information on an assigned car when the elevator responds to the destination call.

2. The elevator system according to claim 1, wherein upon registration of a destination call from the call registration device, the group controller calculates the number of elevators capable of responding to the destination call and makes a judgment as to whether or not an assignment review condition is met on the basis of the calculation results.

3. The elevator system according to claim 1, wherein the call registration device is configured to allow a plurality of kinds of destination call to be registered; and the group controller makes a judgment as to whether or not an assignment review condition is met on the basis of the kind of destination call registered from the call registration device.

4. The elevator system according to claim 1, wherein the group controller makes a judgment as to whether or not an assignment review condition is met on the basis of the distance between the call registration device and an elevator entrance.

5. The elevator system according to claim 1, wherein upon registration of a destination call from the call registration device, the group controller computes the probability of a change of an elevator assignment to the destination call being made and makes a judgment as to whether or not an assignment review condition is met on the basis of the computed probability.

6. The elevator system according to claim 1, wherein the notification device comprises:

a first notification device provided in the vicinity of the call registration device; and a second notification device provided in an elevator hall, normally the group controller causes the first notification device to provide information on an assigned car immediately after registration of a destination call; and in the case where a prescribed assignment review condition is met, immediately after registration of a destination call, the group controller causes the first notification device to provide information to the effect that the registration has been accepted, thereafter reviews the assignment of the elevator, and causes the second notification device to provide information on an assigned car when the elevator responds to the destination call.

* * * * *